United States Patent [19]

Platts

[11] 4,347,004

[45] Aug. 31, 1982

[54] MIXING APPARATUS

[75] Inventor: Stanley A. Platts, Warley, England

[73] Assignee: Unishear Mixers Limited, Tipton, England

[21] Appl. No.: 48,259

[22] Filed: Jun. 13, 1979

[51] Int. Cl.[3] ..... B01F 7/26

[52] U.S. Cl. ..... 366/137; 366/264; 366/290; 366/317

[58] Field of Search ..... 366/262, 264, 270, 290, 366/305, 317, 136, 137, 176, 164, 192, 194, 195, 196; 241/46.11, 46.13, 46.17

[56] References Cited

U.S. PATENT DOCUMENTS

| | | | |
|---|---|---|---|
| 2,882,149 | 4/1959 | Willems | 366/290 X |
| 3,669,414 | 6/1972 | Love | 366/290 |
| 3,820,759 | 6/1974 | Hege | 366/317 X |
| 3,982,700 | 9/1976 | Love | 241/46.11 |

FOREIGN PATENT DOCUMENTS

| | | | |
|---|---|---|---|
| 655503 | 1/1938 | Fed. Rep. of Germany | 366/262 |
| 2061881 | 6/1972 | Fed. Rep. of Germany | 366/176 |
| 1341441 | 12/1973 | United Kingdom | 366/264 |

*Primary Examiner*—Philip R. Coe
*Attorney, Agent, or Firm*—Staas & Halsey

[57] ABSTRACT

A mixing apparatus is provided in which a rotatable impeller is surrounded by a device having radial openings and being in shearing relationship with the impeller so that material urged outwardly through the openings is subjected to a shearing action. A discharge chamber receives material passing through the openings and is thus pressurized so as to discharge material from an outlet of the chamber.

13 Claims, 3 Drawing Figures

MIXING APPARATUS

This invention relates to multi-purpose mixing apparatus for mixing together materials such as solids and liquids for example, and has for an object to provide such an apparatus in which delivery of mixing materials therefrom is facilitated.

According to the invention, a mixing apparatus comprises a main impeller mounted for and drivable in rotation by drive means, means surrounding the main impeller and forming generally radial openings so that material fed to the impeller is urged by the impeller outwardly through said openings, and a discharge chamber arranged to receive material passing through the openings whereby an over-pressure is created in the discharge chamber such that material may be discharged under pressure from an outlet of the discharge chamber.

In one convenient arrangement, a second rotatable impeller is provided and surrounded by a further means forming openings, said second impeller being arranged to urge material through the openings of said further means prior to action thereon by the main impeller.

Preferably, the main and second impellers are driven by and spaced along a common shaft connected to said drive means, the impellers being separated by a disc defining, in part, first and second mixing chambers each containing one of the impellers.

The invention will now be described, by way of example, with reference to the accompanying drawings in which.

Figure 1:
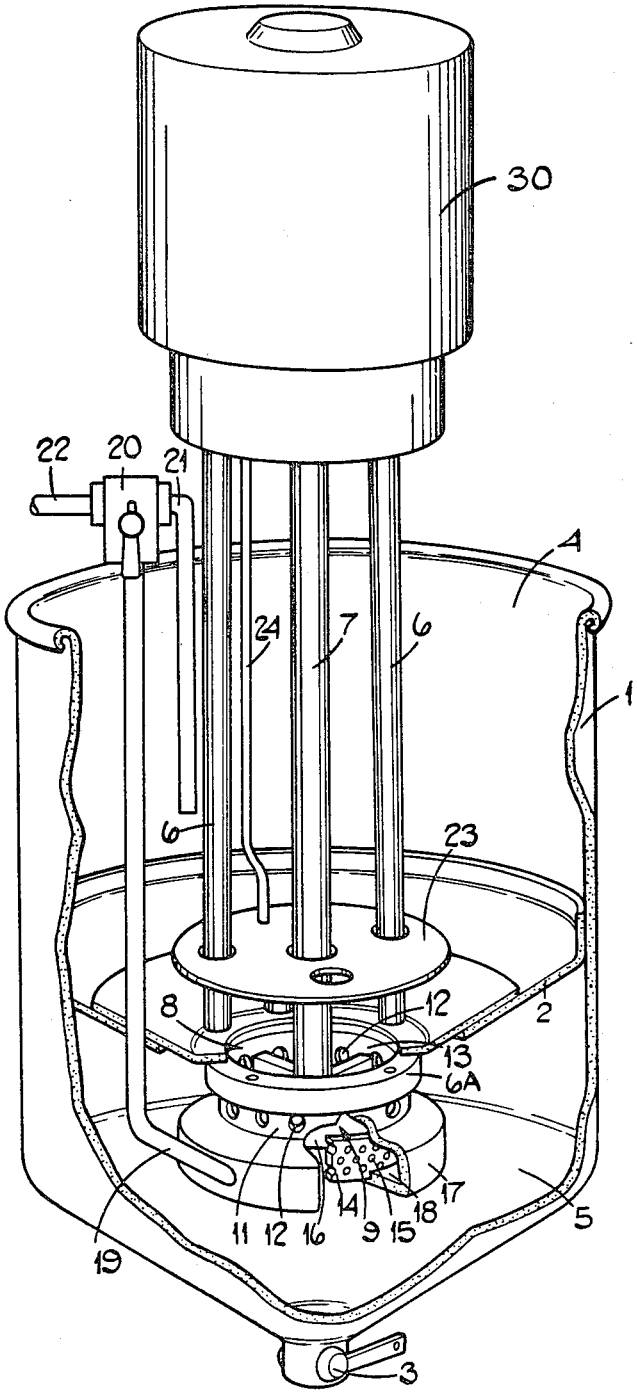
FIG. 1 is a part-fragmentary perspective view of one form of mixing apparatus of the invention.

Referring to FIG. 1, the mixing apparatus shown therein is intended for use in the mixing of solids with liquid, as for example in the manufacture of foods, paints and varnish. The mixing apparatus comprises an outer container 1 having an inner partition 2 and a drain tap 3. As well as dividing the container into upper and lower portions 4 and 5, the partition 2 serves to support a mixing mechanism which includes frame members 6 to which is fixed above the container 1 a driving means, conveniently in the form of an electric motor from which depends a drive shaft 7. The drive shaft is supported at its lower end in a convenient form of bearing mounted in an annular supporting frame 6A located on the under-side of the partition 2.

Figure 2:
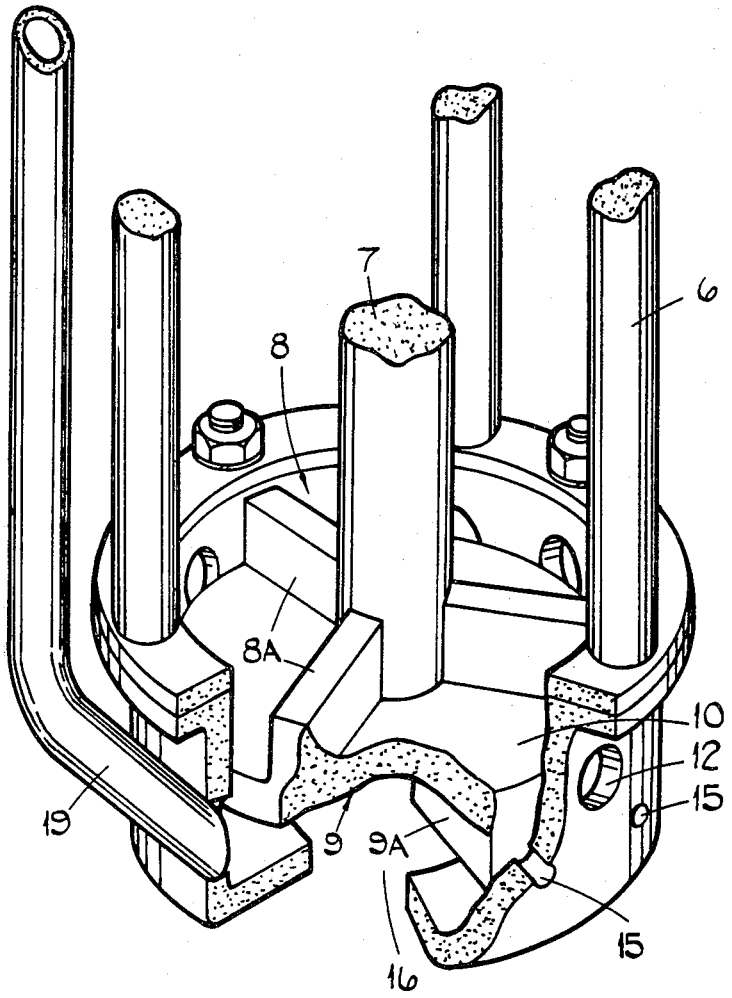
FIG. 2 shows the impellers of FIG. 1 in more detail but in another embodiment of mixing apparatus of the invention.

Secured to the lower end portion of the drive shaft 7 is a pair of impellers 8, 9 mounted one above the other and each having three blades angularly spaced apart by 120°, the blades of the upper impeller being angularly spaced with respect to the blades of the lower impeller by 60°. The impellers are axially separated by a disc 10 (FIG. 2) and the impellers and disc may conveniently be formed as a single casting with the blades projecting from opposite sides of the disc. Although very little detail of the impeller construction can be seen in FIG. 1, it can be seen more clearly from FIG. 2 in which the upper impeller blades are designated 8A, the lower blades 9A and the separating disc is designated 10. Although FIG. 2 shows an alternative embodiment of mixer, the impeller therein may conveniently be the same as that in the FIG. 1 arrangement.

The upper impeller is surrounded by a stationary annular member 11 having a series of large openings 12 therein and defining with the disc 10 an upper mixing chamber 13. The lower impeller 9 is surrounded by a stationary annular member 14 having a large number of openings 15 which are smaller than the openings 12. The annular member 14 defines with the disc 10 a lower mixing chamber 16. Surrounding the member 14 is a hollow casing 17 which defines with the member 14 a pumping chamber 18, from which extends a discharge pipe 19 leading to a three-way valve 20, one outlet 21 of which leads back into the container 1 for recirculation and the other outlet 22 of which leads to an external discharge location.

Also provided within the container 1 is a vortex control plate 23 which is slidable in a vertical direction on the frame members 6 from a position in which it is in abutting relationship with the upper surface of the annular supporting frame 6A so as, in use, to control the vortex created by the upper impeller 8. Movement of the plate may be effected via an operating rod 24 by means of a suitable handle or lever (not shown).

Material to be mixed is supplied to the upper portion 4 of the chamber 1 and is allowed to feed into the upper mixing chamber 13 under the control of the vortex control plate 23. The outer edges of the blades 8A of the upper impeller move in close proximity to the peripheral edges of the openings 12 and, as the impeller draws material, which may be a mixture of lumpy solids and a liquid, into the chamber 13 and expels it outwardly through the openings 12, a shearing action takes place between the aforesaid edges of the blades and openings which rapidly breaks down the solid lumps and effects an efficient mixing thereof with the liquid.

Material passing outwardly through the openings 12 will arrive in the lower portion 5 of the container and will be drawn into the lower mixing chamber 16 by the action of the lower impeller 9. A similar action to that described for the impeller 8 is provided by the impeller 9, shearing taking place between the blades 9A and the edges of the openings 15 and a more finely divided and thoroughly mixed material is ejected outwardly through the openings 15 into the discharge and pumping chamber 18. The latter is sealed around the top and bottom edges of the member 14, except for the openings 15 and the discharge pipe 19. As a result, an over-pressure will be created within the chamber 18, due to the forcing thereinto of material by the lower impeller 9 and this material will be forced along the pipe 19 to the discharge either via outlet 21 back into the container 1 for further mixing, or to an external discharge location via the outlet 22, depending upon the position of the three-way valve 20.

The construction of FIG. 2 is basically similar to that of FIG. 1, the main difference being that the lower mixing chamber 16 acts also as the discharge and pumping chamber. The upper and lower mixing chambers have a common peripheral wall, the upper chamber wall having relatively large openings 12 and the lower chamber wall having smaller openings 15. The lower mixing chamber has the outlet pipe 19 and the size of the holes 15 is chosen in relation to the impeller speed to permit sufficient over-pressure to build up in the chamber 16 to provide the desired pumping action through the pipe 19. The mixer of FIG. 2 would normally be used within a container which may conveniently be similar to that shown in FIG. 1.

Many modifications and variations can be made to the apparatus described above. It would, for example, be possible in any of the embodiments described to provide means, such as a rotatable sleeve surrounding the outer wall of the pumping chamber, to adjust the size of the holes 15, making it possible for the feed pressure to the outlet to be controlled. The invention may also be applied to the mixing apparatus described in British Pat. No. 1,341,441.

Figure 3:
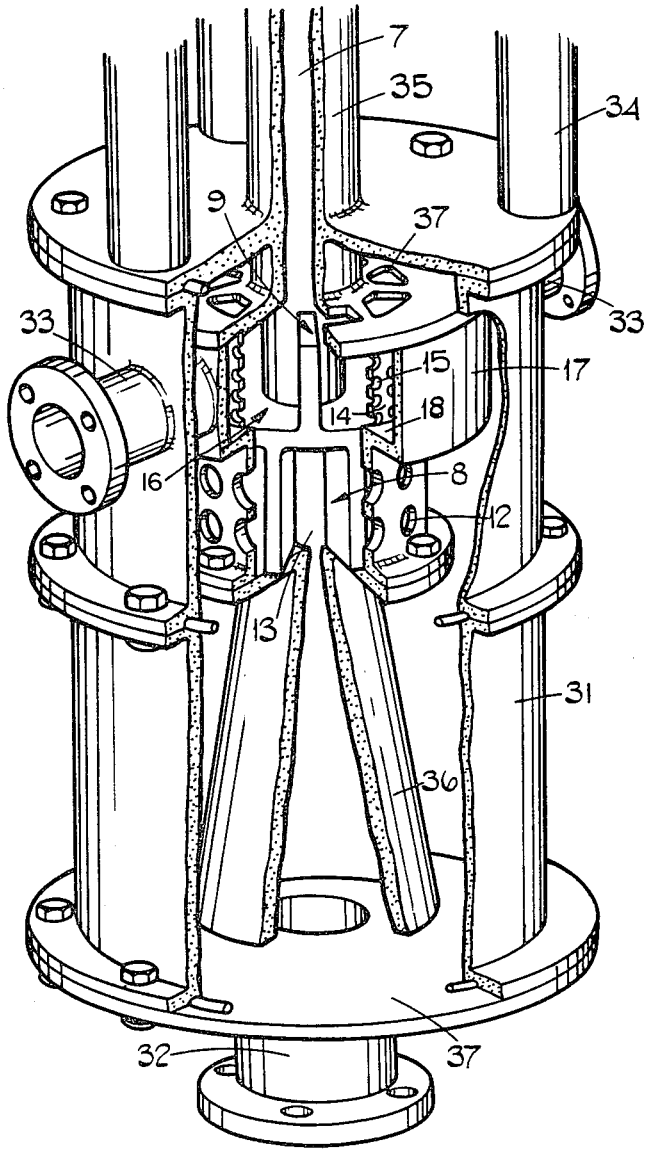
FIG. 3 is a part fragmentary perspective view of an alternative form of mixing apparatus of the invention.

FIG. 3 shows the mixer of the invention incorporated in a closed unit which has a body 31 having a flanged inlet pipe 32 and a pair of flanged outlet pipes 33. The body is provided with frame members 34 to support a motor as before, and a shaft support 35 through which extends a drive shaft for the mixer impellers. The mixer mechanism itself is basically an inverted version of that shown in FIG. 1, the chamber 13 being connected via a venturi 36 to the inlet pipe 32, the lower end of the venturi being sealed against the adjacent end surface 37 of the body.

In use, the inlet 32 would be connected, for example, to a tank, from which material to be mixed is fed along the venturi 36 and into the chamber 13, from which it is discharged under the action of the impeller 8 through the holes 12 and into the interior of the body 31. The body will gradually fill with material until the level is high enough for this material to pass through holes 37 in the upper end of the casing 17 and into the mixing chamber 16. Here the material is further mixed by the impeller 9 and expelled from the mixing chamber through the openings 15 in the annular member 14 and into the discharge and pumping chamber 18. The pumping chamber communicates with the outlets 33 and pressure build-up in the pumping chamber causes liquid to be discharged therefrom through these outlets.

The apparatus of FIG. 3 may be used, as described, to mix liquid fed from a tank and the mixed liquid can either be recirculated to the tank from the outlets 33 or conducted by suitable piping from the outlets to a desired location. The apparatus of FIG. 3 could alternatively be connected into a pipeline at the inlet 32 and in this case it would be desirable for only one outlet to be provided, from which the mixed liquid could be reintroduced into the pipeline from the outlet 33 downstream of the mixer.

I claim:

1. A mixing apparatus comprising a container having a separate enclosure, first and second mixing chambers containing respectively first and second bladed rotary impellers and disposed within said enclosure, the mixing chambers having respective inlets disposed in oppositely facing relationship, the container being arranged to receive material to be mixed supplied to an opening thereof and to supply said material in a first direction into the first mixing chamber through its respective inlet, means surrounding the first impeller forming generally radial openings and being arranged in shearing relation to the blades of the first impeller so that material urged radially outwardly through said openings into an intermediate chamber by rotation of the impeller is subjected to a shearing action, the enclosure being arranged to receive material leaving the first mixing chamber and to communicate with the inlet of the second mixing chamber in a second direction opposed to said first direction, further means surrounding the second impeller forming generally radial openings and arranged in shearing relation with the blades of the second impeller so that material urged outwardly through said openings by rotation of the second impeller is subjected to a shearing action, and a discharge chamber having an outlet and arranged to receive material passing through the openings of said further means and being so constructed and arranged that receipt of such material creates an over pressure in the discharge chamber such that material may be discharged under pressure through said outlet.

2. A mixing apparatus according to claim 1, wherein the first and second impellers are driven by and spaced along a common shaft connected to a drive means.

3. A mixing apparatus according to claim 2 wherein the impellers are axially separated by a disc defining, in part, said first and second mixing chambers, each containing one of the impellers.

4. A mixing apparatus according to claim 3, wherein the impellers and disc are formed in one piece and blades of the respective impellers project from opposite sides of the disc.

5. A mixing apparatus according to claim 1 wherein blades of the first impeller are angularly spaced with respect to blades of the second impeller.

6. A mixing apparatus according to claim 1 wherein the openings in said means surrounding the first impeller are larger than those in the further means surrounding the second impeller.

7. A mixing apparatus according to claim 1, wherein the outlet incorporates valve means for controlling discharge therefrom.

8. A mixing apparatus according to claim 1, wherein the enclosure is formed within said container for material to be mixed, the container being divided by a partition partially defining the enclosure, and the partition having an opening forming an inlet to the mixing chamber containing the first impeller.

9. A mixing apparatus according to claim 8, wherein passage of material through the opening in the partition is controlled by a vortex control plate adjustably mounted adjacent to said partition opening.

10. A mixing apparatus according to claim 8, wherein the enclosure is formed by a casing encircling the mixing chambers and having an inlet and an outlet, the inlet communicating via a venturi tube with the mixing chamber containing the first impeller, which chamber discharges material mixed by the main impeller into the casing, the mixing chamber containing the second impeller communicating with the casing to receive material therefrom which is discharged from the latter chamber through the outlet.

11. A mixing apparatus according to claim 10, wherein the chamber is generally cylindrical and has a plurality of outlets angularly spaced therearound.

12. A mixing apparatus according to claim 1, said outlet of the discharge chamber includes an elongated tube extending through said container.

13. A mixing apparatus according to claim 12, wherein the end of said tube is provided with a valve so that the material may be discharged to an external discharge location or back into the container for further mixing.

* * * * *